US011330876B2

(12) United States Patent
Pryor

(10) Patent No.: US 11,330,876 B2
(45) Date of Patent: May 17, 2022

(54) WAIST WORN WALLET ASSEMBLY

(71) Applicant: Levi Pryor, Buckeye, AZ (US)

(72) Inventor: Levi Pryor, Buckeye, AZ (US)

( * ) Notice: Subject to any disclaimer, the term of this patent is extended or adjusted under 35 U.S.C. 154(b) by 114 days.

(21) Appl. No.: 16/822,748

(22) Filed: Mar. 18, 2020

(65) Prior Publication Data

US 2021/0289900 A1 Sep. 23, 2021

(51) Int. Cl.
*A45C 1/06* (2006.01)
*A45F 3/00* (2006.01)
*A45C 13/02* (2006.01)

(52) U.S. Cl.
CPC ..... *A45C 1/06* (2013.01); *A45C 13/02* (2013.01); *A45F 3/005* (2013.01); *A45F 2003/003* (2013.01)

(58) Field of Classification Search
CPC .. A45C 1/06; A45C 13/02; A45C 1/04; A45F 3/005; A45F 2003/003
USPC ..... 224/681
See application file for complete search history.

(56) References Cited

U.S. PATENT DOCUMENTS 1,972,480 A * 9/1934 Gomi ..... A45C 1/04 224/222
2,351,158 A * 6/1944 Stelzer ..... A45C 1/04 224/199
2,464,350 A * 3/1949 Schmidt ..... A45C 1/024 150/117
D238,725 S * 2/1976 Zerobnick et al. ..... D3/226
4,779,655 A * 10/1988 Olson ..... A45C 1/08 150/112
4,895,198 A 1/1990 Samuelson
5,209,385 A * 5/1993 Ledesma ..... A45C 1/04 224/223
5,294,031 A * 3/1994 Volpei ..... A45F 3/00 224/192
5,374,919 A * 12/1994 Zelka ..... G08B 15/004 224/196
5,499,401 A * 3/1996 Heinmiller ..... A41D 13/081 2/208
5,540,366 A 7/1996 Coomber
5,588,571 A * 12/1996 Mazzo ..... A45C 1/04 150/136
D395,163 S * 6/1998 Huang ..... D3/226
5,836,497 A 11/1998 Pelish
D411,038 S * 6/1999 Fair ..... D3/226
D411,659 S * 6/1999 Karton ..... D3/226
D414,929 S * 10/1999 Brucki ..... D3/226
D419,291 S * 1/2000 Pugh ..... D3/226
6,427,839 B1 * 8/2002 Helfer-Grand ..... A45C 3/00 150/112
6,698,636 B2 3/2004 Angus
6,942,130 B1 * 9/2005 Duva ..... A45F 3/00 135/66
D561,902 S * 2/2008 Fried ..... D24/190
D615,275 S 5/2010 Hacker
(Continued)

*Primary Examiner* — Peter N Helvey

(57) ABSTRACT

A waist worn wallet assembly for storing paper currency on a user's waist includes a wallet that has a pair of storage chambers therein. A plurality of dividers is each positioned within the wallet. Additionally, each of the dividers is positioned in a respective one of the storage chambers to store paper currency is an unfolded and organized manner. A pair of straps is each coupled to the wallet. The pair of straps are matable together to form a closed loop to be worn around a user's waist.

6 Claims, 4 Drawing Sheets

(56) References Cited

U.S. PATENT DOCUMENTS

| | | | | |
|---|---|---|---|---|
| 8,157,140 | B2 | 4/2012 | Jay | |
| 8,215,348 | B1 | 7/2012 | Schreiber | |
| 9,456,672 | B2 * | 10/2016 | Condon | A45C 1/024 |
| D793,720 | S * | 8/2017 | Tien | D3/226 |
| 2006/0151077 | A1 * | 7/2006 | Milford | A45C 11/182 150/147 |
| 2010/0043931 | A1 | 2/2010 | Corea | |

* cited by examiner

WAIST WORN WALLET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wallet devices and more particularly pertains to a new wallet device for storing paper currency on a user's waist.

(2) Description of Related Art Including Information Disclosed Under 37 CFR 1.97 and 1.98

The prior art relates to wallet devices. The prior art discloses a money organizer that can be suspended from a clothes hanger. The prior art discloses a pouch that is wearable around a user's waist for storing monetary currency. Additionally, the prior art discloses a container that can be worn around a user's waist for storing a coin bucket. The prior art discloses a pouch that has a flap for closing the pouch and that is mounted to a belt for wearing around user's waist. The prior art discloses a coin case that has a pouch integrated therein.

BRIEF SUMMARY OF THE INVENTION

An embodiment of the disclosure meets the needs presented above by generally comprising a wallet that has a pair of storage chambers therein. A plurality of dividers is each positioned within the wallet. Additionally, each of the dividers is positioned in a respective one of the storage chambers to store paper currency is an unfolded and organized manner. A pair of straps is each coupled to the wallet. The pair of straps are matable together to form a closed loop to be worn around a user's waist.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
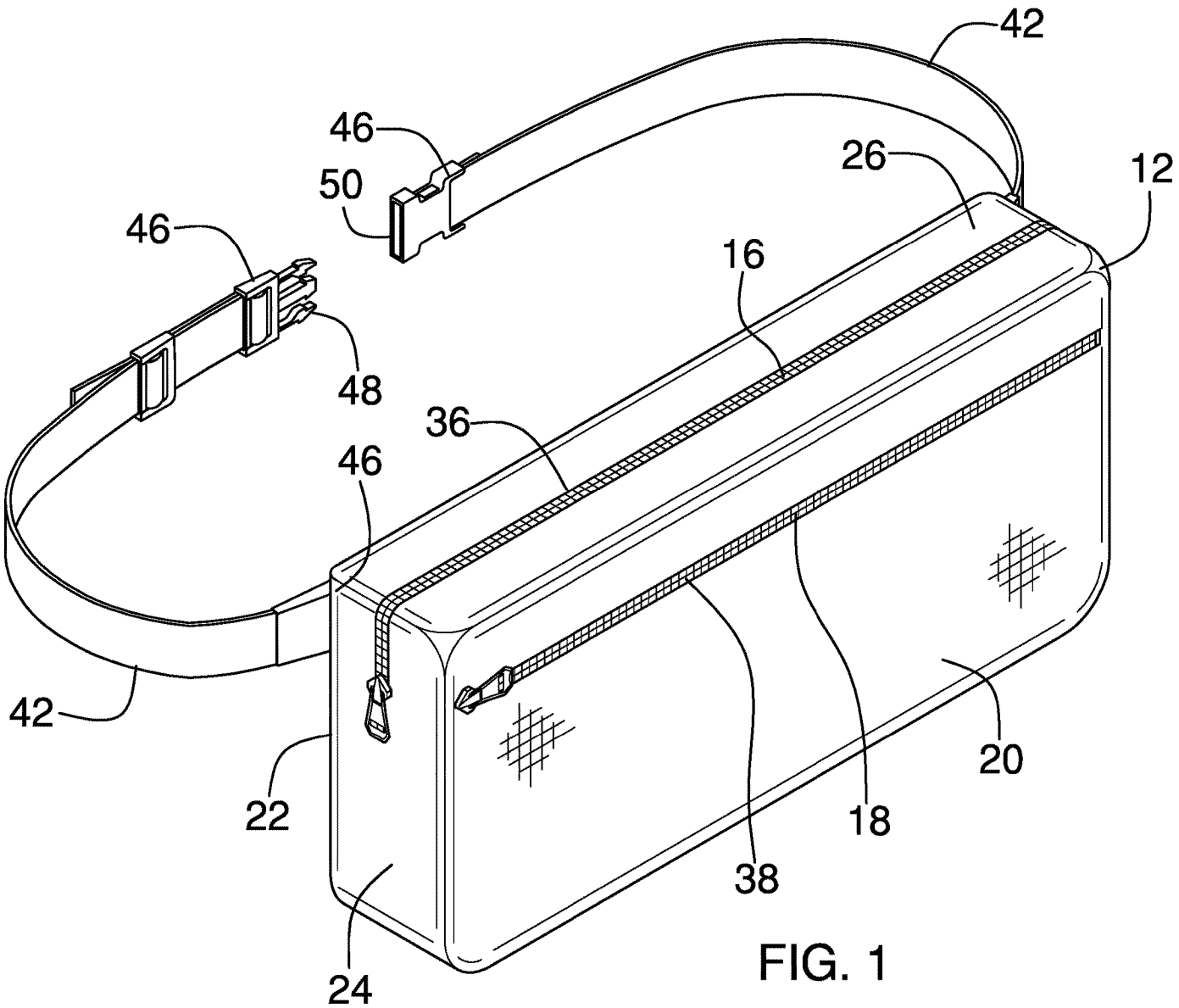
FIG. 1 is a top perspective view of a waist worn wallet assembly according to an embodiment of the disclosure.
Figure 2:
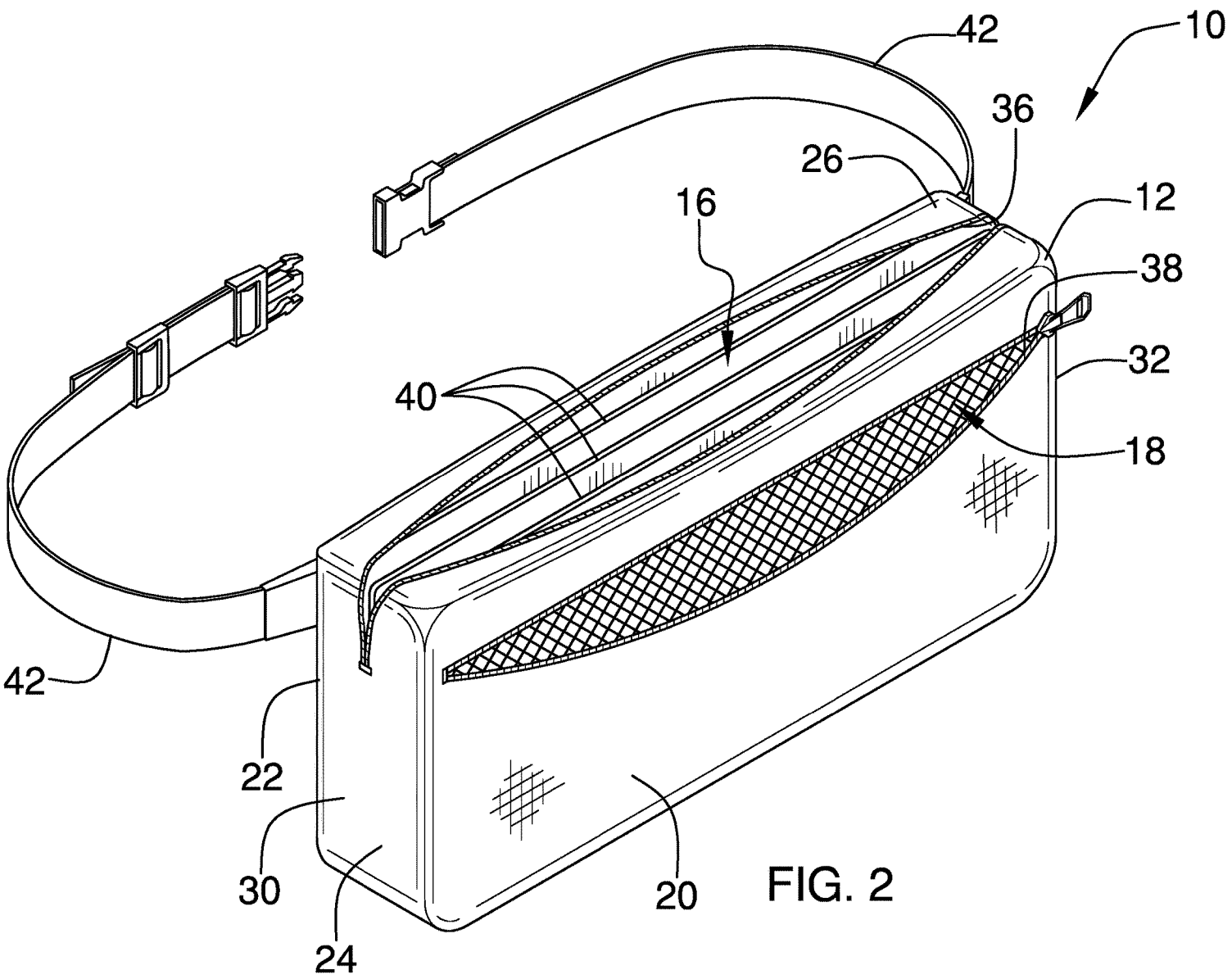
FIG. 2 is a front perspective view of an embodiment of the disclosure.
Figure 3:
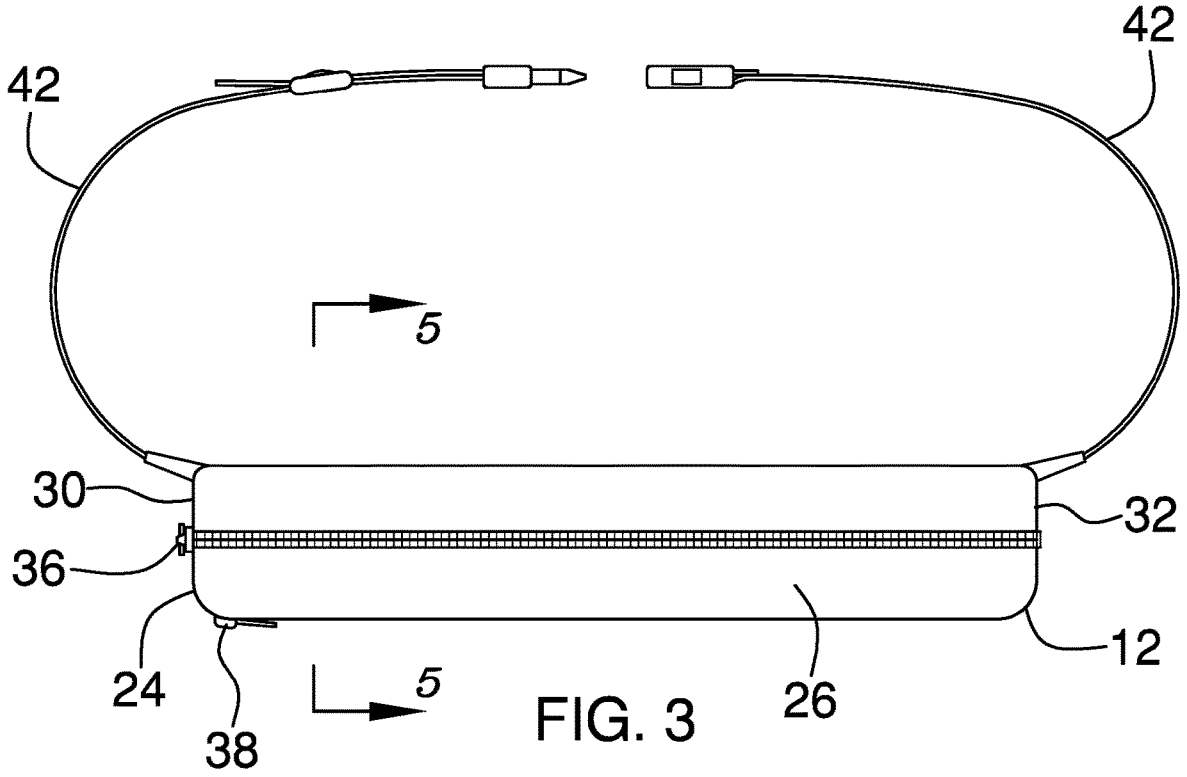
FIG. 3 is a top view of an embodiment of the disclosure.
Figure 4:
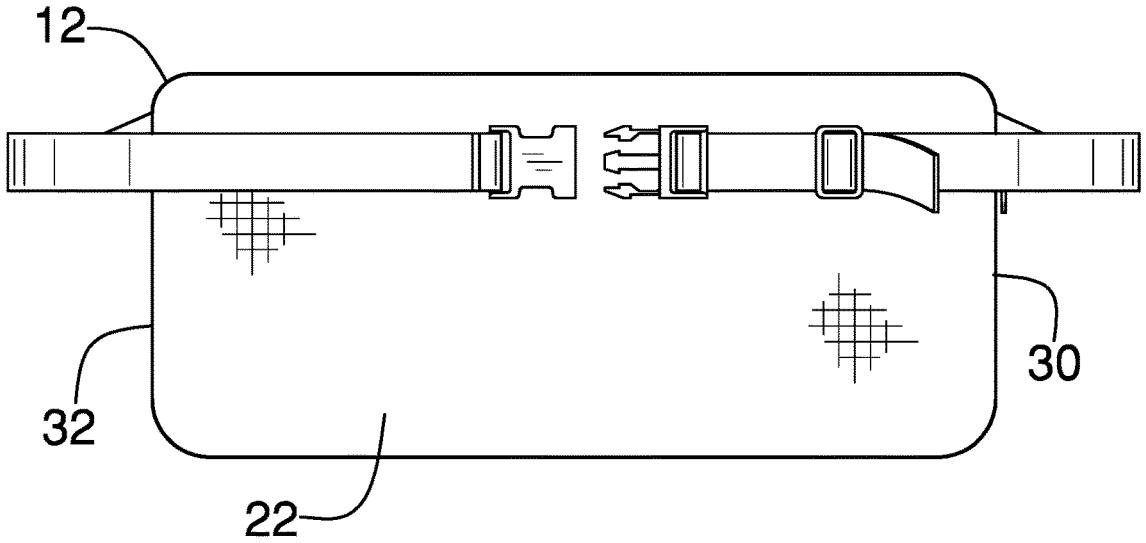
FIG. 4 is a back view of an embodiment of the disclosure.
Figure 5:
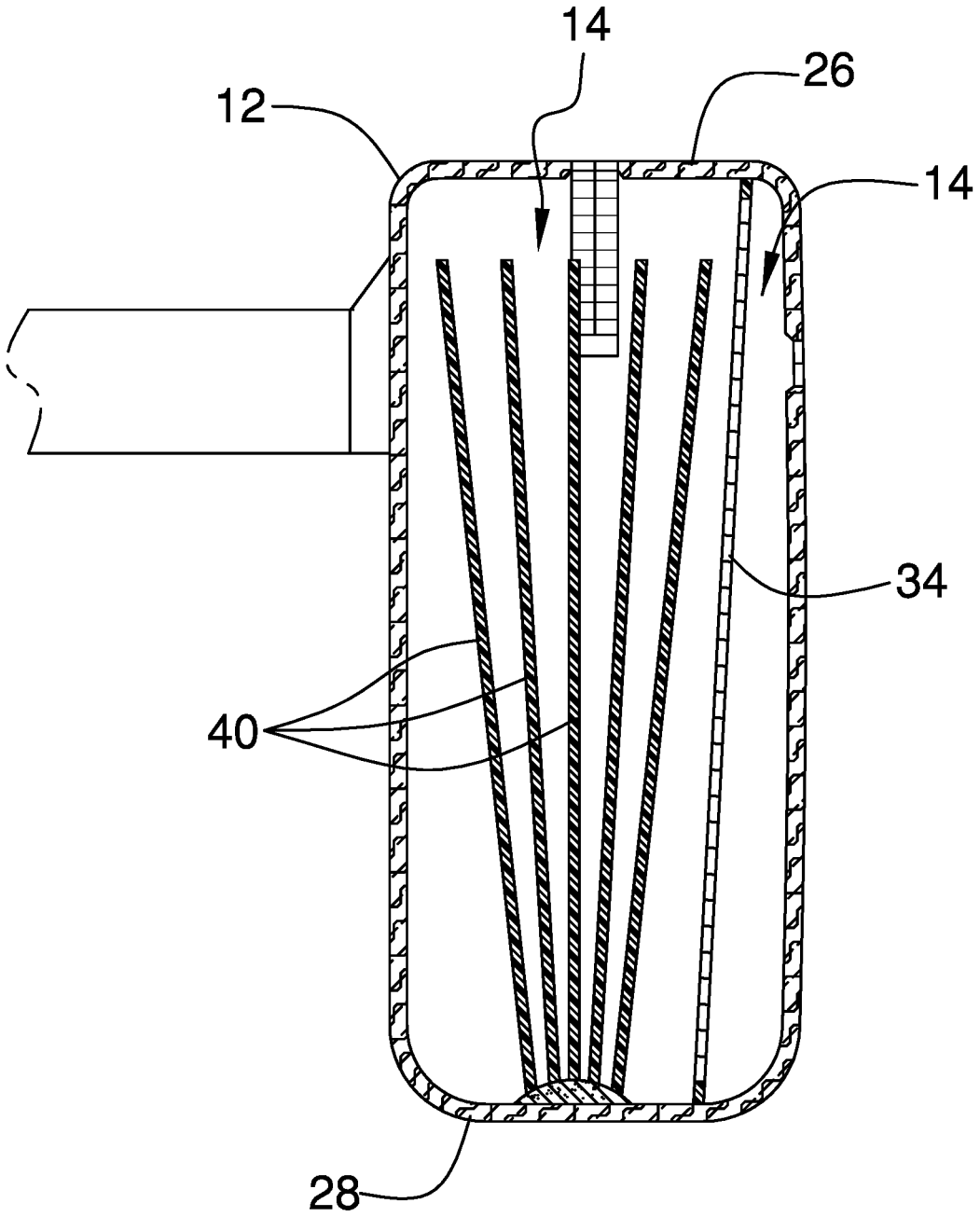
FIG. 5 is a cross sectional view taken along line 5-5 of FIG. 3 of an embodiment of the disclosure.

With reference now to the drawings, and in particular to FIGS. 1 through 5 thereof, a new wallet device embodying the principles and concepts of an embodiment of the disclosure and generally designated by the reference numeral 10 will be described.

As best illustrated in FIGS. 1 through 5, the waist worn wallet assembly 10 generally comprises a wallet 12 has a pair of storage chambers 14 therein. The wallet 12 has a first opening 16 and a second opening 18 each extending into a respective one of storage chambers 14. Additionally, the wallet 12 has a front wall 20, a back wall 22 and a perimeter wall 24 extending therebetween. The perimeter wall 24 has a top side 26, a bottom side 28, a first lateral side 30 and a second lateral side 32.

The wallet 12 has a dividing wall 34 therein that extends between the bottom side 28 and the top side 26 to define the pair of storage chambers 14. The dividing wall 34 is positioned closer to the front wall 20 than the back wall 22. The first opening 16 extends through the top side 26 and the first opening 16 extends between the first lateral side 30 and the second lateral side 32. The second opening 18 extends through the front wall 20 and the second opening 18 extends between the first lateral side 30 and the second lateral side 32.

A first closure 36 is movably coupled to the wallet 12 and the first closure 36 is aligned with the first opening 16 for opening and closing the first opening 16. A second closure 38 is movably coupled to the wallet 12 and the second closure 38 is aligned with the second opening 18 for opening and closing the second opening 18. Each of the first closure 36 and the second closure 38 may comprise a zipper or other type of releasable, mechanical closure.

A plurality of dividers 40 is each positioned within the wallet 12. Each of the dividers 40 is positioned in a respective one of the storage chambers 14 to store paper currency is an unfolded and organized manner. Each of the dividers 40 extends from the bottom side 28 toward the top side 26 of the perimeter wall 24 of the wallet 12. Each of the dividers 40 extends between the first lateral side 30 and the second lateral side 32 of the perimeter wall 24 of the wallet 12. Moreover, the dividers 40 are spaced apart from each other and are distributed between the back wall 22 and the dividing wall 34.

A pair of straps 42 is provided and each of the straps 42 is coupled to the wallet 12. The pair of straps 42 are matable together to form a closed loop for wearing around a user's waist. Each of the straps 42 has a first end 44 and a second end 46, and the first end 44 of each of the straps 42 is coupled to a respective one of the first lateral side 30 and the second lateral side 32 of the perimeter wall 24 of the wallet 12. A first mating member 48 is coupled to the second end 46 of a respective one of the straps 42 and a second mating member 50 is coupled to the second end 46 of a respective one of the straps 42. The first mating member 48 is matable to the second mating member 50. Each of the first mating member 48 and the second mating member 50 may comprise a buckle, a snap or other type of complementary fastener.

In use, the straps 42 are wrapped around the user's waist to wear the wallet 12. In this way the first opening 16 is easily accessible to the user for depositing or retrieving paper currency from the dividers 40. Additionally, the second opening 18 is available for storing objects, such as coins or any other object. In this way a server at a restaurant, a bartender or any other person that exchanges monetary currency with customers can keep paper money and coins discretely stored for easy access.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A waist worn wallet assembly being configured to store monetary currency in an organized and easily accessible fashion, said assembly comprising:

a wallet having a pair of storage chambers therein, said wallet having a first opening and a second opening each extending into a respective one of storage chambers, wherein said wallet has a front wall, a back wall and a perimeter wall extending therebetween, said perimeter wall having a top side, a bottom side, a first lateral side and a second lateral side, said wallet having a dividing wall therein that extends between said bottom side and said top side to define said pair of storage chambers, said dividing wall being positioned closer to said front wall than said back wall, said wallet being elongated between said first lateral side and said second lateral side, said first opening having a first end positioned on said first lateral side proximate to said top side, said first opening having a second end positioned on said second lateral side proximate said top side, said first opening extending from said first lateral side to said second side across said top side;

a first closure being movably coupled to said wallet, said first closure being aligned with said first opening for opening and closing said first opening;

a second closure being movably coupled to said wallet, said second closure being aligned with said second opening for opening and closing said second opening;

a plurality of dividers, each of said dividers being positioned within said wallet, each of said dividers being positioned in said a respective one of said storage chambers wherein each of said dividers is configured to store paper currency is an unfolded and organized manner, wherein each of said dividers extends from said bottom wall toward said top wall, each of said dividers extending between said first lateral side and said second lateral side of said perimeter wall of said wallet, said dividers being spaced apart from each other and being distributed between said back wall and said dividing wall;

a spine having a planar surface coupled to said bottom side of said wallet within said first storage chamber, each of said dividers having a bottom edge coupled to an arcuate upper surface of said spine; and a pair of straps, each of said straps being coupled to said wallet, said pair of straps being matable together to form a closed loop wherein said pair of straps is configured to be worn around a user's waist.

2. The assembly according to claim 1, wherein said second opening extending through said front wall, said second opening extending between said first lateral side and said second lateral side.

3. The assembly according to claim 1, wherein each of said straps has a first end and a second end, said first end of each of said straps being coupled to a respective one of said first lateral side and said second lateral side of said perimeter wall of said wallet.

4. The assembly according to claim 3, further comprising a first mating member being coupled to said second end of a respective one of said straps.

5. The assembly according to claim 4, further comprising a second mating member being coupled to said second end of a respective one of said straps, said first mating member being matable to said first mating member.

6. A waist worn wallet assembly being configured to store monetary currency in an organized and easily accessible fashion, said assembly comprising:

a wallet having a pair of storage chambers therein, said wallet having a first opening and a second opening each extending into a respective one of storage chambers, said wallet having a front wall, a back wall and a perimeter wall extending therebetween, said perimeter wall having a top side, a bottom side, a first lateral side and a second lateral side, said wallet having a dividing wall therein that extends between said bottom side and said top side to define said pair of storage chambers, said dividing wall being positioned closer to said front wall than said back wall, said wallet being elongated between said first lateral side and said second lateral side, said first opening having a first end positioned on said first lateral side proximate to said top side, said first opening having a second end positioned on said second lateral side proximate said top side, said first opening extending from said first lateral side to said second side across said top side, said second opening extending through said front wall, said second opening extending between said first lateral side and said second lateral side;

a first closure being movably coupled to said wallet, said first closure being aligned with said first opening for opening and closing said first opening;

a second closure being movably coupled to said wallet, said second closure being aligned with said second opening for opening and closing said second opening;

a plurality of dividers, each of said dividers being positioned within said wallet, each of said dividers being positioned in said a respective one of said storage chambers wherein each of said dividers is configured to store paper currency is an unfolded and organized manner, each of said dividers extending from said bottom wall toward said top wall, each of said dividers extending between said first lateral side and said second lateral side of said perimeter wall of said wallet, said dividers being spaced apart from each other and being distributed between said back wall and said dividing wall;

a spine having a planar surface coupled to said bottom side of said wallet within said first storage chamber, each of said dividers having a bottom edge coupled to an arcuate upper surface of said spine;

a pair of straps, each of said straps being coupled to said wallet, said pair of straps being matable together to form a closed loop wherein said pair of straps is configured to be worn around a user's waist, each of said straps having a first end and a second end, said first end of each of said straps being coupled to a respective one of said first lateral side and said second lateral side;

a first mating member being coupled to said second end of a respective one of said straps; and a second mating member being coupled to said second end of a respective one of said straps, said first mating member being matable to said first mating member.

* * * * *